United States Patent [19]

Kloster

[11] 3,985,201

[45] Oct. 12, 1976

[54] INFINITE SOUND REPRODUCTION CHAMBER

[76] Inventor: Glenn R. Kloster, San Dimas, Calif.

[22] Filed: Oct. 24, 1974

[21] Appl. No.: 517,552

[52] U.S. Cl. ..... 181/163; 179/116; 179/181 R

[51] Int. Cl.[2] ..... H04R 7/12

[58] Field of Search ..... 181/144, 148, 157, 160, 181/161, 163, 167, 171–173; 179/116, 181 R

[56] References Cited

UNITED STATES PATENTS

| | | | |
|---|---|---|---|
| 1,672,796 | 6/1928 | Whitmore | 181/163 |
| 1,735,860 | 11/1929 | Hutchison | 181/144 |
| 1,859,892 | 5/1932 | Ricker | 181/163 |
| 1,862,582 | 6/1932 | Schlenker | 181/163 |
| 1,864,615 | 6/1932 | Quinby | 179/146 |
| 1,930,186 | 10/1933 | Swallow | 181/163 |
| 2,013,695 | 9/1935 | Nicolson | 179/146 |
| 3,456,755 | 7/1969 | Walker | 181/163 |

*Primary Examiner*—Lawrence R. Franklin

[57] ABSTRACT

The sound reproduction chamber comprises a diaphragm enclosure comprising a frame, a pair of parabolic diaphragm covers, and a resonating generator. The parabolic diaphragm covers may be mounted in the frame with their foci disposed distally adjacent one another or opposed in a convex parabolic diaphragm.

15 Claims, 5 Drawing Figures

INFINITE SOUND REPRODUCTION CHAMBER

This application is a substitute for Ser. No. 389,940, filed Aug. 20, 1973, now abandoned.

FIELD OF INVENTION

The present invention relates to loud-speakers and more particularly to sound reproduction chambers having a pair of opposingly disposed parabolic diaphragms driven by a modulating, resonating generator.

DESCRIPTION OF THE PRIOR ART

Speakers of the prior art are commonly classified by terms which describe their important functional parts: the motor, the diaphragm, and the acoustical radiation-controlling element. The motor or resonance generator converts electrical energy into mechanical energy, and couples the electrical signals source, commonly an amplifier, to the diaphragm. Common motor types are moving-conductor (principally moving coil or dynamic, rarely ribbon conductor) and electrostatic. Moving conductor speakers are those in which mechanical forces result from magnetic reactions between the field of the current in a moving conductor and a steady magnetic field. In a moving-coil speaker, the conductor is in the form of a coil conductively connected to a source of electrical energy, and mechanically attached to the diaphragm. An electrostatic speaker is one in which mechanical displacements are produced by action of electrostatic fields. Speakers are also classified by their radiation-controlling elements in direct-radiator (hornless) or horn types. Direct-radiator types commonly employ the baffles for enclosures.

The diaphragm is the element which, vibrated by the motor, causes air to vibrate; hence, it couples the air load (radiation impedance) to the motor. Almost universally, the diaphragm emits only one direction, i.e. the diaphragm is a monoplayer. This characteristic of conventional loud-speakers tends to ignore the element that the motor or generator resonates along at least two places: one in which the diaphragm is disposed and one in the direction opposite.

Accordingly, it is an object of the present invention to provide a sound reproduction chamber in which the diaphragm is operable to cooperate along both planes of vibration of the generator or motor.

It is a further object of this invention that the motor or generator be exposed between diaphragms of the speaker at the point at which reception of the impulse vibration and transmission of the resultant wave may be maximized.

It is an object of the present invention to provide a resonating generator which may operate in the present sound reproduction chamber with high sensitivity and auditory clarity.

These and other objects shall become apparent from the description following, it being understood that modifications may be made without affecting the teachings of the invention here set out.

SUMMARY OF THE INVENTION

The sound reproduction chamber comprises a diaphragm enclosure comprising a frame, a pair of parabolic diaphragm covers, and a resonating generator. The parabolic diaphragm covers may be mounted in the frame with their foci disposed distally adjacent one another or opposed in a convex parabolic diaphragm.

The resonating generator may be mounted at the center of the diaphragm closure, such as at one corner of the enclosure, at one corner in line with the diagonal axis of the corner in which the diaphragm is mounted, or in a plurality of corners of the closure. It is a primary principle of the present invention that the resonating generator emit from the largest cubic region formed by the diaphragm and diaphragm covers, and emit into the center of the diaphragm closure.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
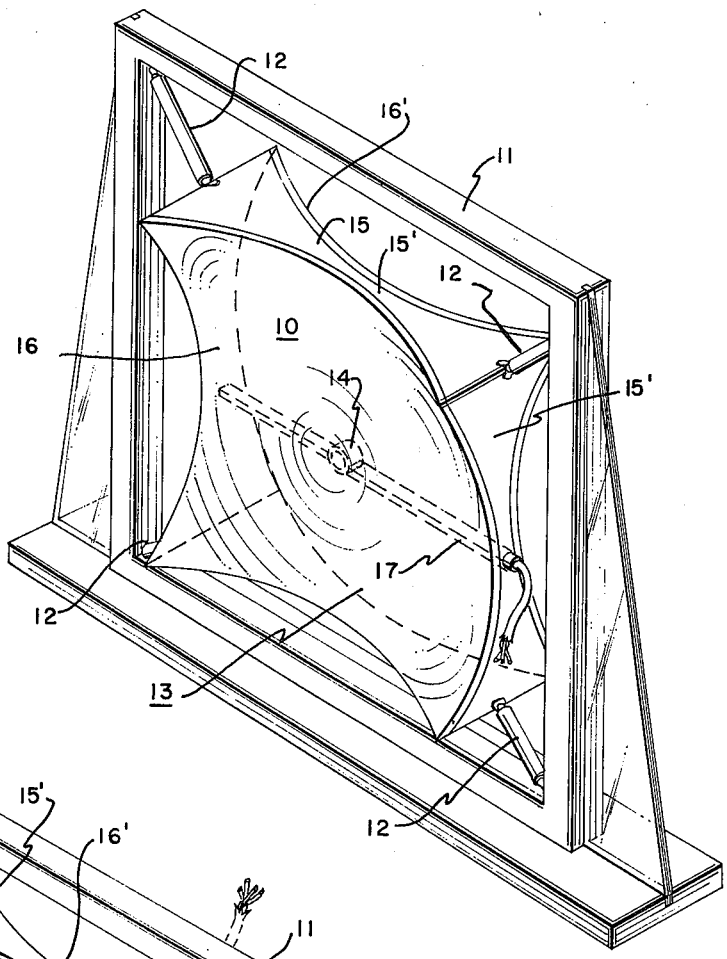
FIG. 1 is a perspective view of the sound reproduction chamber of this invention having a resonating generator suspended at the focus diaphragm thereof.

Referring now to the drawings and more particularly to FIG. 1, the sound reproduction chamber of this invention is shown to advantage and generally identified by the numeral 10. The chamber 10 is suspended in a suitably stable framework 11 by means such as elastomer springs 12. The chamber 10, itself, comprises a diaphragm enclosure 13 and a resonating generator 14.

The diaphragm enclosure 13 comprises a frame 15 and a pair of concave parabolic diaphragm covers 16 and 16' which are mounted in the frame 15 with their points of deepest curvature disposed adjacent one another. The frame 15 is an enclosure which may have a rectangular configuration comprising a plurality of sides 15'. Each side 15' has a substantially hyperbolic configuration in which the rectilinear edges are cut with a smooth concave arc having its apex substantially at the midpoint of one of the sides 15'. It has been found that a particularly pleasing sound results when the sides 15' are fabricated of a fibrous material, such as wood. This advantageous result is further enhanced if the grain of the fibrous material is disposed transversely with respect to each side 15'. Thus, it is understood that the sides 15' should be cut with the grain in alignment, or in the same direction, regardless of the angle or position of the frames, to allow sound to flow freely throughout the entire structure of the frame 15. Further, it is to be understood that if the grain is disposed transversely with respect to the sides 15' there should result a free movement and vibration of the frame 15 as a whole. Each of the diaphragms 16 and 16′ has a concave parabolic configuration with the points of deepest curvature being disposed at the center of the frame 15. It may be seen that the concave parabolic curvature of the diaphragms 16 and 16′ are operable to mate with the curvature of each side of the hyperbolically configured sides 15′. The diaphragms 16 and 16′ may be fabricated in any of a variety of ways and using any of a variety of materials, including flexible or fabric materials, such as coated canvas and the like. The diaphragms 16 and 16′ may also be fabricated of rigid films or sheets which may be fabricated of polymeric materials. It is also to be understood that the diaphragm enclosure 13 may be fabricated as a hollow enclosure, or as a cellular or honeycomb filled enclosure having a plurality of pockets.

The resonating generator 14, which is electrically connected to a transducer circuit and amplifier of the sort associated with sound reproduction equipment, is mounted in contact with the points of deepest curvature on the diaphragms 16 and 16′. Means mounting the resonating generator 14 may include a suspension member 17 fastened to the frame 15. The resonating generator 14 may be of the type selected from magnetic armatures, pneumatic, piezoelectric, and magnetostricting having means for applying impulses to both diaphragms 16 and 16′. It is essential that at least one of the faces of the resonating generator 14 be in direct contact with the diaphragm enclosure 13. The contacting face of the generator 14 may be laminated or fastened directly to at least one of the diaphragm covers 16 and 16′. It may be seen that means mounting and supporting the resonating generator 16 may be selected from any of a number of means, such as the member 17, or by an independent bracket (not shown). This configuration permits the core of the resonating generator 14 to more freely resonate, and thus increase the sensitivity.

In operation, the resonating generator 14 receives electrical impulses in the manner of commonly known loud-speakers and the like, and should transmit resultant vibrations to the diaphragms 16 and 16′. It may be seen that the diaphragms 16 and 16′ are operable to transmit and amplify the vibrations into sound along both directions of radiation from each face. It may be seen that the areas over which pulses vibrate on the diaphragms 16 and 16′ are radically greater and more uniform than loud-speaker diaphragms known heretofore. Sensitivity and intensity of sound produced by the chamber 10 will be substantially magnified over corresponding impulses in conventional loud-speakers.

Figure 2:
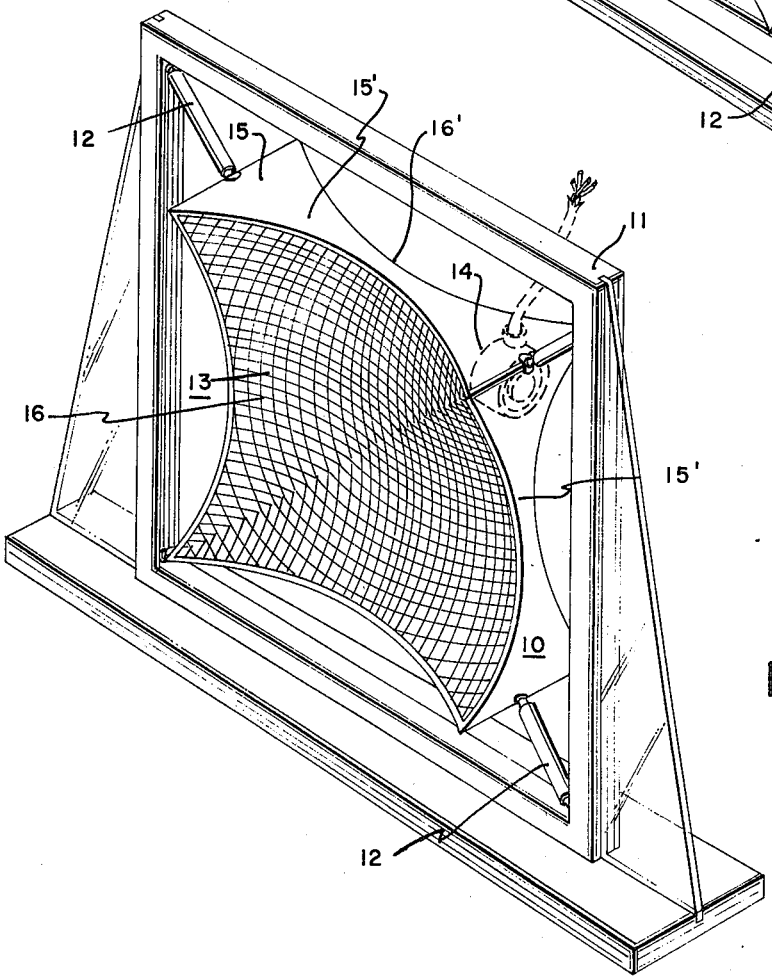
FIG. 2 is a perspective view of a further embodiment of the sound reproduction chamber having the resonating generator thereof mounted at one of the corners of the diaphragm enclosure.

Referring to FIG. 2, a further embodiment of the present sound reproduction chamber includes a framework 11, diaphragm enclosure 13, and generator 14 of the type substantially identical to the chamber 10 set out above. In the further embodiment, however, the resonating generator 14 is mounted in one of the corners of the diaphragm enclosure 13, being operable to emit vibrations or impulses into the enclosure formed by the frame 15 and the diaphragms 16 and 16′. The resonating generator 14 is permitted to vibrate into the free space, such that the resultant waves permeate the diaphragm enclosure 13. Alternatively, the resonating generator 14 may be fastened with one of its resonating faces in direct contact with the frame 15.

Operation of the sound reproduction chamber 10 of the further embodiment is substantially the same as the chamber 10 set out above. In the further embodiment, permeation of vibrations throughout the diaphragm enclosure 13, resulting from the location of the resonating generator 14, tends to further increase sensitivity and inherent magnification of sound from the initial electrostatic signal. It is apparently an important element of this invention that the location of the resonating generator 14 emit into the center of the diaphragm enclosure 13 from one of the largest cubic regions in the enclosure formed by the diaphragm enclosure 13.

Figure 3:
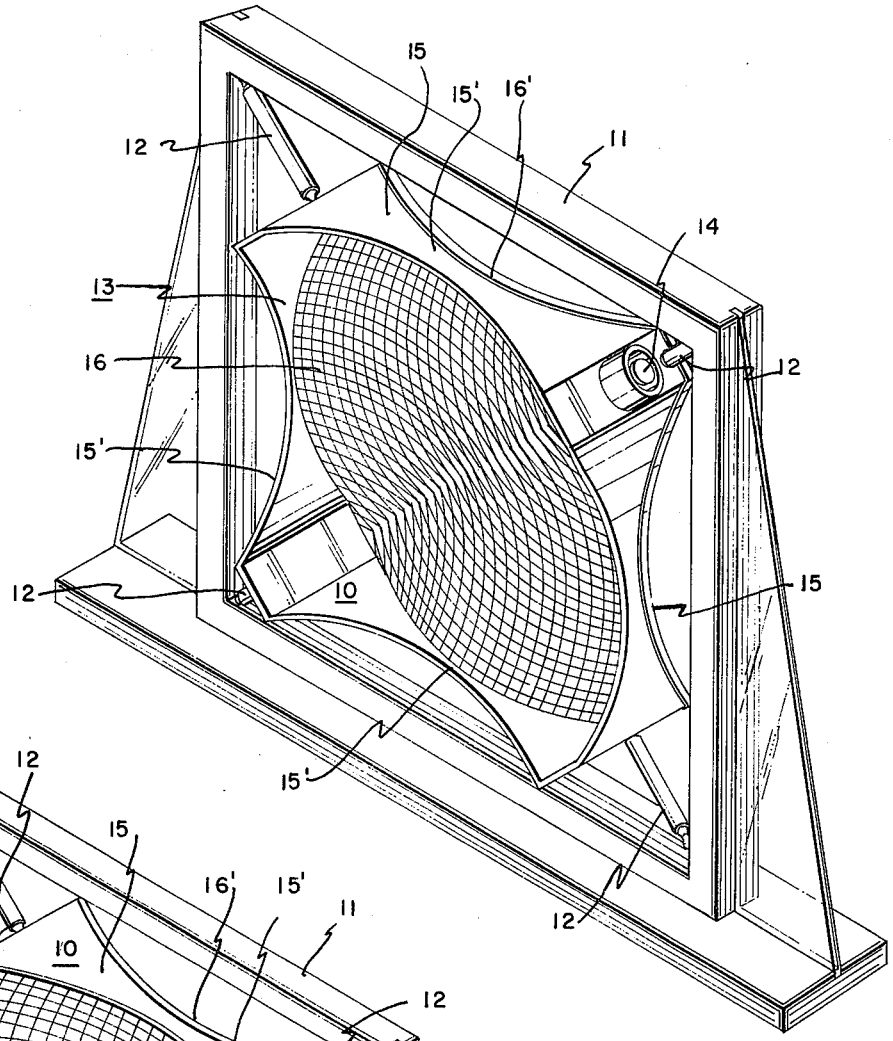
FIG. 3 is a perspective view of a still further embodiment of the sound reproduction chamber having the resonating generator disposed at one corner and with its central axis disposed along a diagonal line from said corner.

Referring to FIG. 3, a still further embodiment of the sound reproduction chamber 10 includes a framework 11, a diaphragm enclosure 13 and a resonating generator 14 of the character set out above with respect to the FIG. 2. In the present further embodiment, the alignment of the axis of emission of the generator 14 is disposed along one of the diagonal axes of the diaphragm enclosure 13. This may be accomplished by fastening at least one face of the resonating generator 14 directly to the frame 15. From the latter embodiment above, it may be seen that the principle of a centrally focused vibration source would be maximized by the alignment of the diagonally disposed generator 14, through the center of the enclosure 13. This would tend to further increase the advantages found in the sound reproduction chamber 10 of the FIG. 2.

Figure 4:
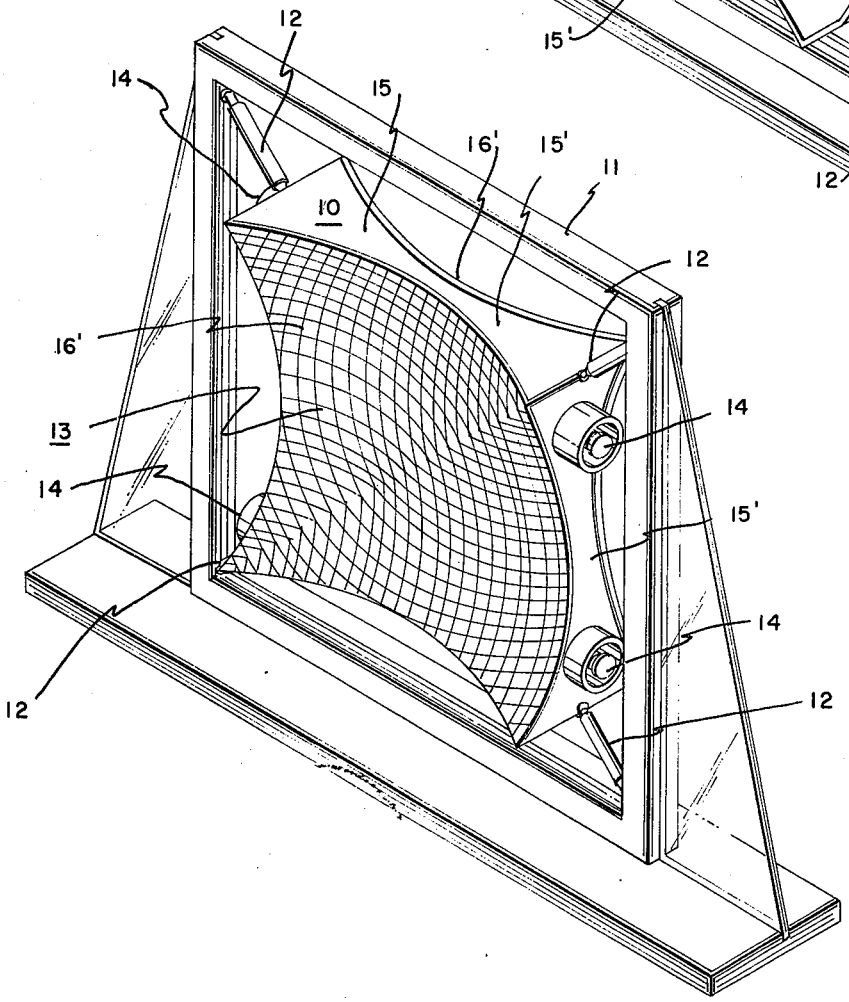
FIG. 4 is another embodiment of the sound reproduction chamber having resonating generators disposed at each corner of the diaphragm.

Referring to FIG. 4, another embodiment of the sound reproduction chamber 10 may, in similar fashion to the embodiments of the chamber 10 set out above, include the framework 11, the diaphragm enclosure 13, and the resonating generator 14. In the present embodiment, the chamber 10 is provided with a resonating generator 14 at each of the corners of the frame 15 to emit into the enclosure 13 formed by the frame 15 and the diaphragms 16 and 16′. The generator 14 may be mounted into one of the sides 15′ of the frame 15 in the manner described in FIGS. 2 and 3. Operation of the present embodiment is substantially similar to the chambers 10 set out above. It may be seen that, consistent with the teachings of the embodiments of the FIGS. 3 and 4, a plurality of generators 14 may be disposed at corners of the diaphragm enclosure 13 along the diagonal axes of the respective corners in which each is mounted.

Figure 5:
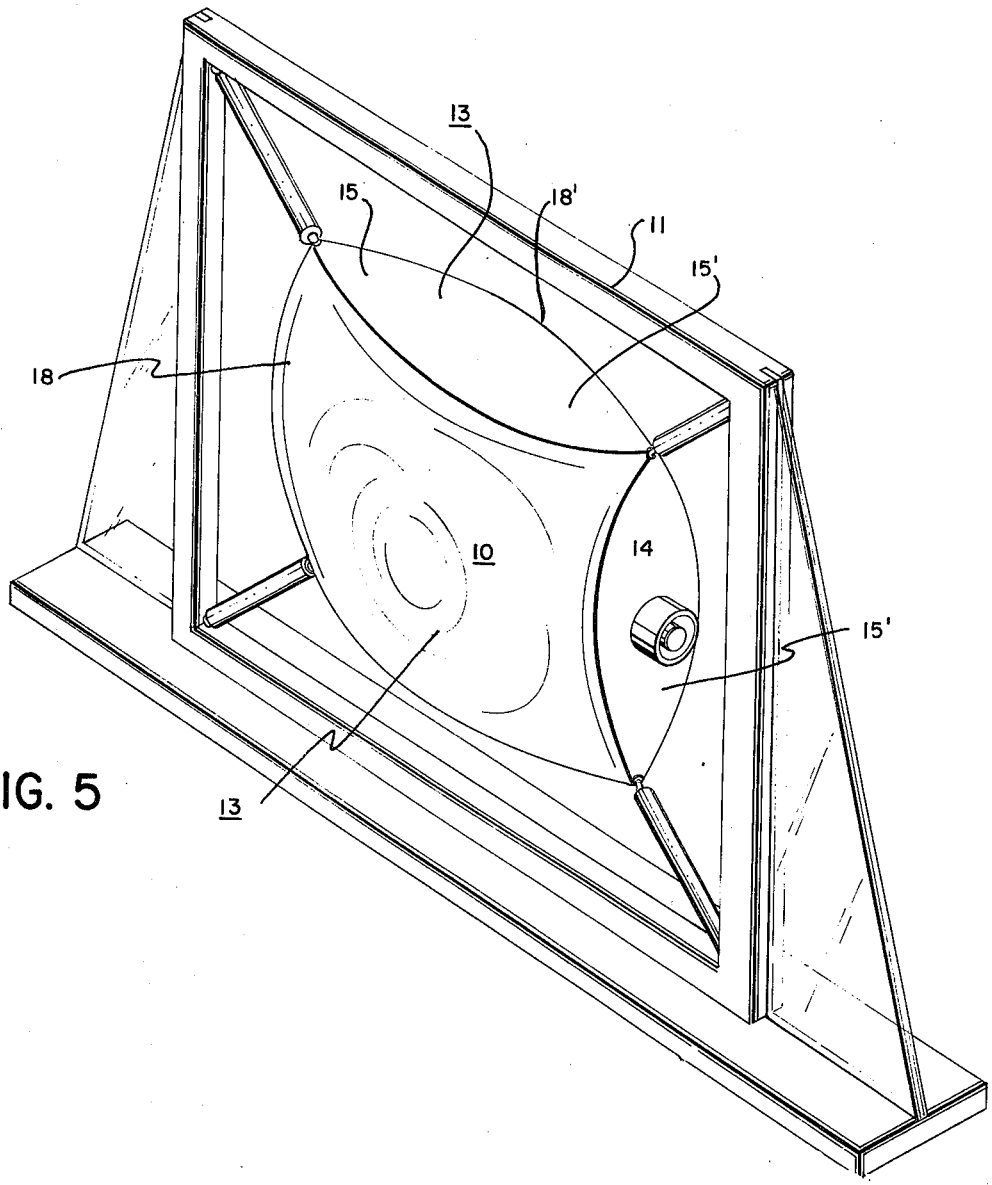
FIG. 5 is another embodiment of the sound reproduction chamber having a convex parabolic diaphragm enclosure and a resonating generator disposed in one of the terminal sides thereof.

Referring to FIG. 5, a still further embodiment of the sound reproduction chamber 10 includes supporting framework 11 and the resonating generator 14 of the type set out above. In the latter embodiment, the diaphragm enclosure 13 is provided with a pair of convex parabolic diaphragms 18 and 18′ disposed with their respective points of deepest curvature away from the center of the diaphragm enclosure 13. Accordingly, the frame 15 is provided with a plurality of side walls having a substantially elliptical configuration, such that the perimeters of the respective diaphragms 18 and 18′ may mate with the edges of the walls 15′. In accordance with the principles set out above, the resonating generator 14 is disposed at the major focus of one of the sides 15′ to emit into the center of enclosure, between the respective points of deepest curvature of the diaphragm enclosure 13. The resonating generator 14 may be fastened with one of its resonating faces in direct contact with the side wall 15. It is to be understood that, while the generator 14 is so disposed in one of the sides 15′ in the illustrated embodiment, other juxtapositions of the generator 14, including one with the generator 14 within the diaphragm enclosure 13, may be employed to produce sound suitable for other desired purposes.

Operation of the latter embodiment of the chamber 10 having the convex parabolic diaphragms 18 and 18' is substantially as set out above: the generator 14 is operable to emit vibrations of impulses into the diaphragm enclosure 13. The surface of each of the diaphragms 18 and 18' then vibrate in response to radiation of the generator 14 to produce sound.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A sound reproduction chember, comprising:

a diaphragm enclosure including a pair of parabolic diaphragm covers disposed at a suitable distance apart and opposingly with their foci juxtapositioned in cross-sectional alignment, a frame enclosing the space between said diaphragm covers about the perimeter of said diaphragm covers; and a resonating generator communicating into the interior of said diaphragm enclosure being connected directly to vibrate said diaphragm enclosure to produce sound.

2. The apparatus of claim 1 wherein each of said parabolic diaphragm covers are disposed concavely with respect to the outside of said diaphragm enclosure with their points of deepest curvature disposed adjacently at a suitable distance to one another.

3. The apparatus of claim 1 wherein each of said parabolic diaphragm covers are disposed convexly with respect to the outside of said diaphragm enclosure.

4. The apparatus of claim 3 wherein said frame is rectangular and each side forming said frame is substantially ellipitical configuration to mate with the perimeter edges of said diaphragm covers.

5. The apparatus of claim 4 wherein said resonating generator is disposed centrally in one of said elliptical shaped side members of said frame.

6. The apparatus of claim 1 wherein said resonating generator is disposed substantially between the center defined by the points of deepest curvature of said parabolic diaphragm covers with axis of emmission disposed through the center of said diaphragm enclosure.

7. The apparatus of claim 1 wherein said resonating generator is disposed in the largest region enclosed by said parabolic diaphragm covers in said frame.

8. The apparatus of claim 1 wherein said frame has a substantially rectangular configuration, and each of the side members thereof have a substantially hyperbolic configuration to mate with the perimeter edge of said parabolic covers.

9. The apparatus of claim 8 wherein said resonating generator is disposed in one corner of said diaphragm enclosure.

10. The apparatus of claim 9 wherein said resonating generator disposed in the corner of said diaphragm enclosure emits along the diagonal axis through the center of said parabolic diaphragm covers.

11. The apparatus of claim 10 wherein a plurality of resonating generators are disposed at corners of said frame with their central rectilinear axis disposed diagonally through the centers between said parabolic diaphragm covers.

12. The apparatus of claim 9 wherein a plurality of resonating generators are disposed at a number of corners of said enclosure frame.

13. The apparatus of claim 1 wherein said diaphragm enclosure is suspended in a suitable framework.

14. The apparatus of claim 1 wherein said parabolic diagragm covers are fabricated of a suitable flexible fabric-like material.

15. The apparatus of claim 1 wherein said parabolic diaphragm covers are fabricated of a thin rigid film.

* * * * *